United States Patent [19]

Scott et al.

[11] 4,063,732

[45] Dec. 20, 1977

[54] BALL BAT

[75] Inventors: Irvin C. Scott; Evan E. Settle, III; Robert J. Hickerson, all of Richmond, Va.

[73] Assignee: Reynolds Metals Company, Richmond, Va.

[21] Appl. No.: 711,631

[22] Filed: Aug. 4, 1976

[51] Int. Cl.[2] ..... A63B 59/06

[52] U.S. Cl. ..... 273/72 A; 403/379

[58] Field of Search ..... 273/67 R, 67 A, 67 DA, 273/68, 70, 72 R, 72 A, 73 J, 75, 81 R, 80.2–80.5; 43/23; 145/61 R; 151/5; 74/551.8, 551.9, 558, 558.5; 403/378, 379; 85/5 N, 7, 8.1

[56] References Cited

U.S. PATENT DOCUMENTS

| | | | |
|---|---|---|---|
| 2,369,344 | 2/1945 | Ehmann | 85/7 X |
| 3,175,314 | 3/1965 | Williamson | 403/379 X |
| 4,000,895 | 1/1977 | Scott et al. | 273/72 A |

FOREIGN PATENT DOCUMENTS

| | | | |
|---|---|---|---|
| 1,473,295 | 2/1967 | France | 273/72 A |

*Primary Examiner*—Richard J. Apley

*Attorney, Agent, or Firm*—Glenn, Lyne, Gibbs & Clark

[57] ABSTRACT

A ball bat is provided and comprises a body member which terminates a tone end with a hollow handle portion having a pair of aligned holes, a knob fitted to the handle portion and having a pair of aligned holes in aligned relationship with the aligned holes in the handle portion, and a pin which extends through the pair of aligned holes in the knob and the pair of aligned holes in the handle portion and which follows a circuitous path through the hollow of the handle portion.

2 Claims, 4 Drawing Figures

BALL BAT

BACKGROUND OF THE INVENTION

This invention relates to ball bats, and more particularly, to ball bats, such as metal ball bats of substantial tubular construction, of the type comprising a body member terminating at one end with a handle portion to which a knob is fitted.

In the fabrication of ball bats of the kind herein under discussion, those skilled in the pertinent art have been concerned heretobefore with how to best go about securing the knob to the handle portion of the ball bat body member. It has thus been variously proposed that this end be achieved by such means as threading, friction fitting, gluing or utilizing certain fasteners such as split pins, screws or rivets.

The prior methods have, however, been typically subject to objection on account of their cost or the ease with which the first secured knob may become later detached, either by deliberate act or by accident as an incident of normal use of the ball bat.

SUMMARY OF THE INVENTION

It is accordingly one object of this invention to provide a mechanically simple and inexpensive means for securing a knob to the handle portion of a ball bat body member. It is further an object of this invention to provide a means for securing a knob to the handle portion of a ball bat body member in a manner effective to minimize the likelihood of the knob becoming later detached, either by deliberate act or by accident as an incident of normal use of the ball bat.

With these and other objects in view, this invention includes a ball bat comprising a body member constructed to terminate at one end with a hollow handle portion having a pair of aligned holes, a knob fitted to the handle portion and having a pair of aligned holes in aligned relationship with the aligned holes in the handle portion, and a pin which extends through the pair of aligned holes in the knob and the pair of aligned holes in the handle portion and which follows a circuitous path through the hollow of the handle portion. For purposes of appearance and to further ensure that the pin will not subsequently be removed, at least one of the pair of aligned holes in the knob may be a blind hole.

In the assembly of the ball bat of this invention, the knob may be fitted to the handle portion and the pin, in substantially straight condition, may be fitted such that it extends through the pair of aligned holes in the knob and the pair of aligned holes in the handle portion. The pin may thereupon be bent to follow a circuitous path through the hollow of the handle portion, whereby the knob will be secured to the handle portion with a substantial degree of permanence.

While various methods for causing the initially straight pin to follow a circuitous path as described should become immediately apparent to those skilled in the pertinent art, one such method is presently preferred and therefore deserving of being particularly pointed out. In accordance with this method, the knob is provided with a third hole intermediated to the mentioned pair of aligned holes therein and in communication with the hollow of the handle portion to which the knob is fitted, and the pin is then bent by striking its central portion with a suitable tool or drift inserted through the third hole in the knob.

DESCRIPTION OF THE DRAWINGS

This invention, together with its several objects and the manner by which it is practiced, will be more fully appreciated after a reading of the description to follow, with reference to the appended drawings in which.

DESCRIPTION OF THE ILLUSTRATED EMBODIMENTS

Figure 1:
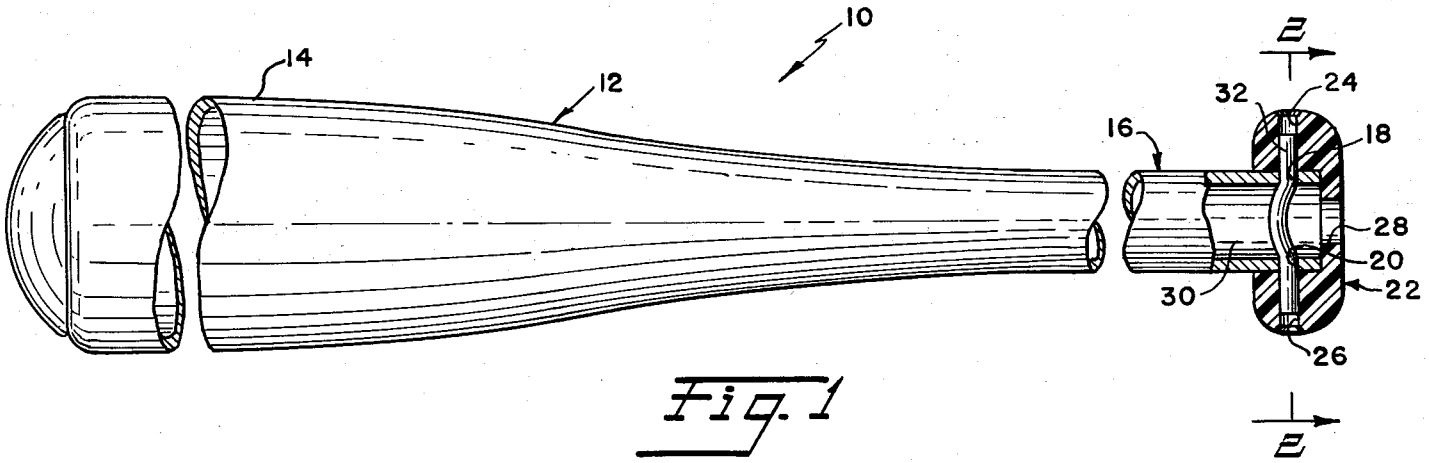
FIG. 1 is a view, with parts in elevation, parts in cross section and parts broken away, in illustration of an exemplary embodiment of the ball bat of this invention.

Reference is now made to FIG. 1 of the drawings in illustration of an exemplary embodiment of the ball bat of this invention, such embodiment being designated generally as bat 10. Comprising the bat 10 is a tubular body member 12, having a hitting end portion 14, which terminates at one end with a handle portion 16 having a pair of aligned holes 18 and 20. Fitted to the handle portion 16 is a disc-like knob 22 having a pair of aligned holes 24 and 26 in aligned relationship with the pair of aligned holes 18 and 20, and also having a third hole 28 intermediate to the pair of aligned holes 18 and 20 and in communication with the hollow 30 of the handle portion 16. As can be seen, the knob 22 is secured to the handle portion 16 by a pin 32 which extends through the pair of aligned holes 16 and 18 and the pair of aligned holes 24 and 26 and which follows a circuitous path through the hollow 30 of the handle portion 16.

It should be appreciated generally that any circuitous path of the pin 32 through the hollow 30, that is to say any path other than the most direct path connecting the pair of aligned holes 18 and 20, should assist to ensure that the pin 32 will not subsequently be removed. It is preferred however, that the pin 32 be bent at points sufficiently adjacent the aligned holes 18 and 20 such that on attempting to move the pin 32 through the aligned holes 18 and 20 the pin will tend to bind in the hole toward which its central portion is forced, while the respective end portions of the pin 32 each remain contained by the aligned holes 24 and 26 in the knob 22.

Figure 3:
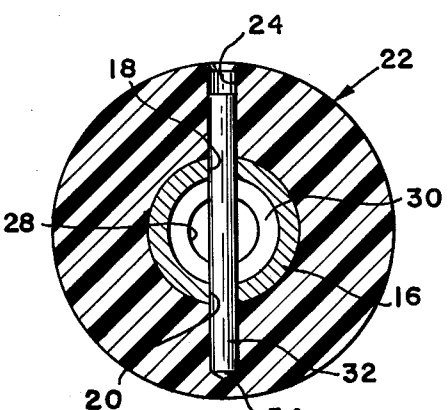
FIG. 3 is a cross sectional view of illustration of another exemplary embodiment of the knob of the ball bat of this invention wherein the knob has a blind hole.
Figure 2:
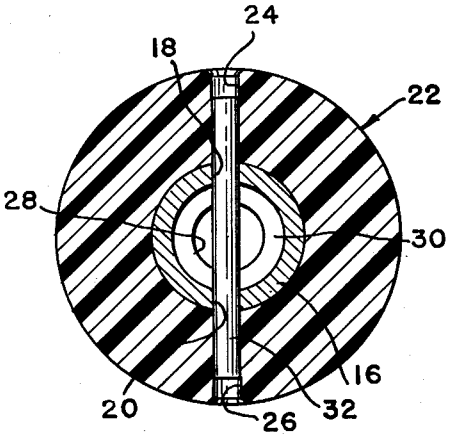
FIG. 2 is a cross sectional view taken along the line 2—2 of FIG. 1, in illustration of an exemplary embodiment of the knob of the ball bat of this invention.

To further minimize the likelihood of the subsequent removal of the pin 32, the pin 32 can be selected so as to have a tight friction fit in the pair of aligned holes 18 and 20 and the pair of aligned holes 24 and 26. For the same purpose, and for the sake of appearance, one hole of the pair of aligned holes 24 and 26, such as the hole 26, may be a blind hole 34 as illustrated in FIG. 3.

Figure 4:
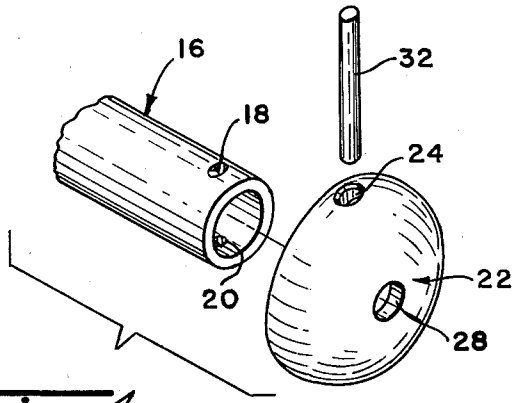
FIG. 4 is an exploded perspective view particularly illustrating the hollow handle portion of the ball bat of FIG. 1, the knob, and the pin, in substantially straight condition, to be utilized for securing the knob to the handle portion.

In the assembly of the bat 10, the knob 22 may be fitted to the handle portion 16 and the pin 32, in substantially straight condition as shown in FIG. 4, may be fitted such that it extends through the pair of aligned holes 24 and 26 and the pair of aligned holes 18 and 20. The pin 32 may thereupon be bent to follow the requisite circuitous path through the hollow 30 of the handle portion 16, whereby the knob 22 will be secured to the handle portion 16 with a substantial degree of permanence.

In accordance with the preferred method for causing the initially straight pin 32 to follow a circuitous path as described, the pin 32 is bent by striking its central portion with a suitable tool or drift inserted through the third hole 28 in the knob 22. Other methods for achieving this end should also become apparent however. For example, a completely hollow body member 12 might be provided and the pin 32 might be bent by striking its central portion with a suitable tool or drift inserted through the body member 12 from its end associated with its hitting and portion 14. On the other hand, it may be found convenient merely to exert the necessary force directly against the end of the knob 22 which if appropriately designed would in turn act against the pin 22 to cause the desired effect. Alternatively, compressive force might be applied against the opposed ends of the pin 32 in order to cause it to buckle.

As required, exemplary embodiments of this invention, together with manners and processes by which they may be made and used, have now been illustrated and described. It will be appreciated, however, that numerous variations of such exemplary embodiments may be carried out without departing from the invention as defined by the following claims.

What is claimed is:

1. A ball bat comprising:

a. a body member which terminates at one end with a hollow handle portion having a pair of aligned holes;

b. a knob fitted to said handle portion and having a pair of aligned holes in aligned relationship with the aligned holes in said handle portion; and c. a pin which extends through the pair of aligned holes in said knob and the pair of aligned holes in said handle portion and which follows a circuitous path through the hollow of said handle portion, said circuitous path being such that on attempting to move said pin through the pair of aligned holes in said handle portion said pin would tend to bind in the hole in said handle portion toward which the central portion of said pin is forced, while the respective end portions of said pin remain contained by the pair of aligned holes in said knob.

2. The ball bat of claim 1 wherein one hole of the pair of holes in said knob is a blind hole.

* * * * *